US008313584B1

(12) United States Patent
Szabo

(10) Patent No.: US 8,313,584 B1
(45) **Date of Patent: *Nov. 20, 2012**

(54) VEHICLE MOUNTED GARBAGE CAN CLEANER AND METHOD

(75) Inventor: Ernest Szabo, Richmond, IL (US)

(73) Assignee: Rapid Wash Group, Ltd., DesPlaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/317,813

(22) Filed: Jan. 9, 2012

Related U.S. Application Data

(63) Continuation of application No. 12/393,337, filed on Feb. 26, 2009, now Pat. No. 8,118,948.

(51) Int. Cl.
*B08B 9/00* (2006.01)
*B08B 3/00* (2006.01)

(52) U.S. Cl. ..... 134/169 R; 134/111; 134/166 R; 134/170; 134/198; 414/406; 414/408

(58) Field of Classification Search ..... 134/111, 134/166 R, 169 R, 170, 198; 414/406, 408
See application file for complete search history.

(56) References Cited

U.S. PATENT DOCUMENTS

| | | | | |
|---|---|---|---|---|
| 5,807,056 | A * | 9/1998 | Osborn et al. | 414/406 |
| 6,554,008 | B2 * | 4/2003 | Dewey et al. | 134/22.18 |
| 8,118,948 | B1 * | 2/2012 | Szabo | 134/169 R |
| 2001/0046430 | A1 * | 11/2001 | Bayne | 414/408 |
| 2005/0000870 | A1 * | 1/2005 | Ricketts | 210/107 |
| 2008/0110476 | A1 * | 5/2008 | Amestoy et al. | 134/34 |

FOREIGN PATENT DOCUMENTS

EP 712671 A1 * 5/1996

OTHER PUBLICATIONS

English Machine Translation of EP 712671 A1.*

* cited by examiner

*Primary Examiner* — Michael Kornakov
*Assistant Examiner* — Nicole Blan
(74) *Attorney, Agent, or Firm* — Mathew R. P. Perrone, Jr.

(57) ABSTRACT

A vehicle mounted cleaning device cleans a series of large garbage containers at one at time, while recycling, reusing and retaining the cleaning fluid, until disposal thereof is required. The vehicle mounted cleaning device permits the vehicle to be maneuvered down a street. The cleaning device has a cleaning bin or wash bay to receive the garbage or trash container. A cleaning fluid tank communicates with nozzles in the wash bay to provide fluid for cleaning the garbage container. After the fluid is used to clean the garbage container, it is filtered, treated and returned to the cleaning fluid tank for use.

1 Claim, 18 Drawing Sheets

VEHICLE MOUNTED GARBAGE CAN CLEANER AND METHOD

CROSS-REFERENCE TO RELATED APPLICATION

This application is a continuation of U.S. patent application Ser. No. 12/393,337, filed Feb. 26, 2009, now issued on Feb. 21, 2012, with U.S. Pat. No. 8,118,948.

This invention relates to a vehicle mounted garbage can cleaner and more particularly to a vehicle mounted trash or garbage container or can cleaner, which permits the garbage to be cleaned from a side of a transport vehicle, and have the cleaning agent recycled for reuse, while being stored on the vehicle until proper disposal thereof is possible.

BACKGROUND OF THE INVENTION

Sanitation is a critical feature in any society, whether in the modern society or ancient society. Sanitation being performed in a proper manner creates desirable living conditions. Sanitation being improperly performed can and does lead to sickness and even death on a massive scale. In fact anthropologists attribute the demise of many ancient villages to a failure of sanitation.

To that end, modern society devotes energy, time and material to efficiently providing sanitation for its inhabitants. Typically, a residence or a business will collect waste material in smaller containers within the respective building. Then, each container, whether it contains garbage or recyclable material is emptied into a larger container. That larger container is usually stored outside the respective building.

After use, the larger container, especially the one used for garbage, requires replacement or cleaning. A proper cleaning of the large container can easily be more environmentally friendly than replacement of that larger container. Yet, the size of that larger container can easily interfere with a proper cleaning thereof, as well as the proper disposal of the cleaning materials. To that end, there are a number of devices for cleaning large containers, which hold large amounts of garbage and are suitable for containing garbage, until the disposal can be complete.

None of those devices can efficiently clean a garbage container at the curb and return it to the curb. Such devices require moving the container to a desired spot, such as the rear of the vehicle for cleaning. Such devices require a great amount of physical labor and lack the efficiency required for a proper cleaning.

All of those devices lack efficiency in the cleaning of large containers. What is needed is a vehicle mounted cleaning device, which can efficiently clean the large container at its location. Such cleaning involves lifting, cleaning, possibly otherwise treating, and placing back in to position. Then, the cleaning device must efficiently move into position to clean the next container. The resulting cleaning solution must be used efficiently and stored efficiently.

SUMMARY OF THE INVENTION

Among the many objectives of the present invention is the provision of a vehicle mounted cleaning device, which efficiently lifts, cleans and returns a large garbage container to its desired position.

Another objective of the present invention is the provision of a vehicle mounted cleaning device, which recycles the cleaning fluid.

Yet another objective of the present invention is the provision of a vehicle mounted cleaning device, which holds the cleaning fluid for proper disposal.

Still another objective of the present invention is the provision of a vehicle mounted cleaning device, which minimizes the movement of the large garbage container.

Also, an objective of the present invention is the provision of a vehicle mounted cleaning device, which cleans the large garbage container right at the side of the road.

A further objective of the present invention is the provision of a vehicle mounted cleaning device, which avoids moving the large garbage container to the rear of the vehicle.

A still further objective of the present invention is the provision of a vehicle mounted cleaning device, which cleans the large garbage container at the side of the vehicle.

These and other objectives of the invention (which other objectives become clear by consideration of the specification, claims and drawings as a whole) are met by providing a vehicle mounted cleaning device suitable for a series of large garbage containers at one at time, while recycling, reusing and retaining the cleaning fluid, until disposal thereof is required.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
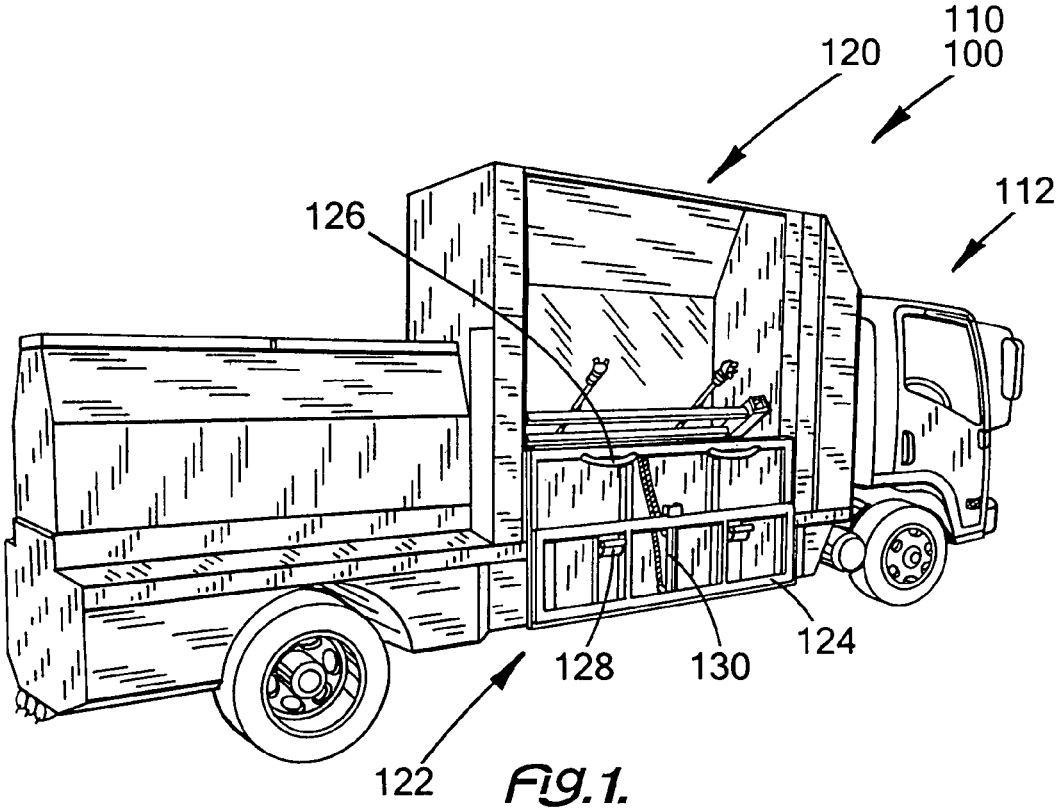
FIG. 1 depicts a perspective view of the vehicle mounted cleaning device 100 of this invention positioned on the vehicle 110.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

The vehicle mounted cleaning device permits the vehicle to be maneuvered down a street. The cleaning device has a cleaning bin or wash bay to receive the garbage or trash container from the side of the vehicle. A cleaning fluid tank or a filtered water tank communicates with nozzles in the wash bay to provide fluid for cleaning the garbage container. After the fluid is used to clean the garbage container, it is sent to dirty water or recycling tank to be filtered, treated and returned to the cleaning fluid tank or filtered water tank for reuse.

As a preferred form, for better weight distribution, the wash bay is adjacent to the cab of the truck or vehicle. Adjacent to the wash bay and oppositely disposed from the cab, is the cleaning fluid tank or filtered water tank. The dirty water is adjacent to cleaning fluid tank or filtered water tank and oppositely disposed from the wash bay. This arrangement provides for better weight distribution with the cleaning fluid present.

Any effective cleaning fluid may used. Typically the cleaning fluid is water based with soap or detergent incorporated therein as an emulsion or a solution. Of course, water alone may be used. Ecologically effective sanitizing agents may also be used.

When the large garbage container is placed by the street, the vehicle positions a lifting device close enough to mechanically lift the container into the cleaning bin or wash bay. The cleaning fluid is applied to the interior of the garbage container for the most part as the container is tilted downwardly. The composition or force of the cleaning fluid cleans the container. Then the container is returned to the side of the street as desired.

Throughout the specification, trash or garbage can or container are used interchangeably. So the cleaning device is usable on a trash can, a trash container, a garbage can, a garbage container or combinations thereof.

Also, throughout the specification, the cleaning fluid tank and the filtered water tank are used interchangeably. The dirty water tank and the recycling tank are used interchangeably to refer to the same component. Finally, the cleaning bin and the wash bay are used interchangeably to refer to the area where the trash containers are cleaned.

In FIG. 1, vehicle mounted cleaning device 100 is mounted on vehicle 110. Adjacent to the cab 112 of vehicle 110 is wash bay 120. Mounted adjacent to the wash bay 120 on a side of vehicle 110 is the lift and tilt assembly 122. Lift and tilt assembly 122 includes lock frame 124. Lock frame 124 has a stop bar 126 to cooperate with a container lock 128.

Figure 2:
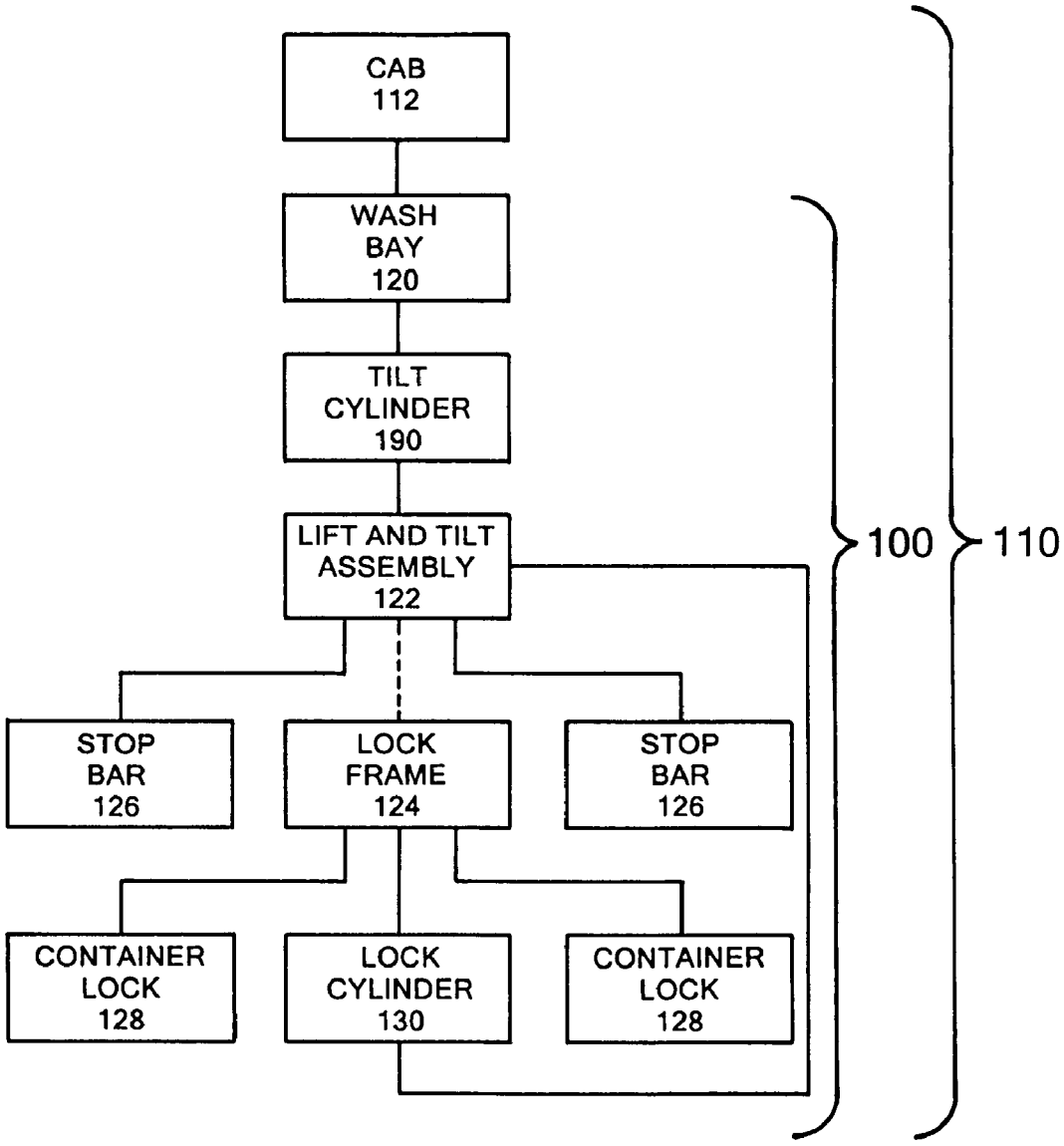
FIG. 2 depicts a block diagram of the lift and tilt assembly 122 for the vehicle mounted cleaning device 100 of this invention positioned on the vehicle 110.
Figure 19:
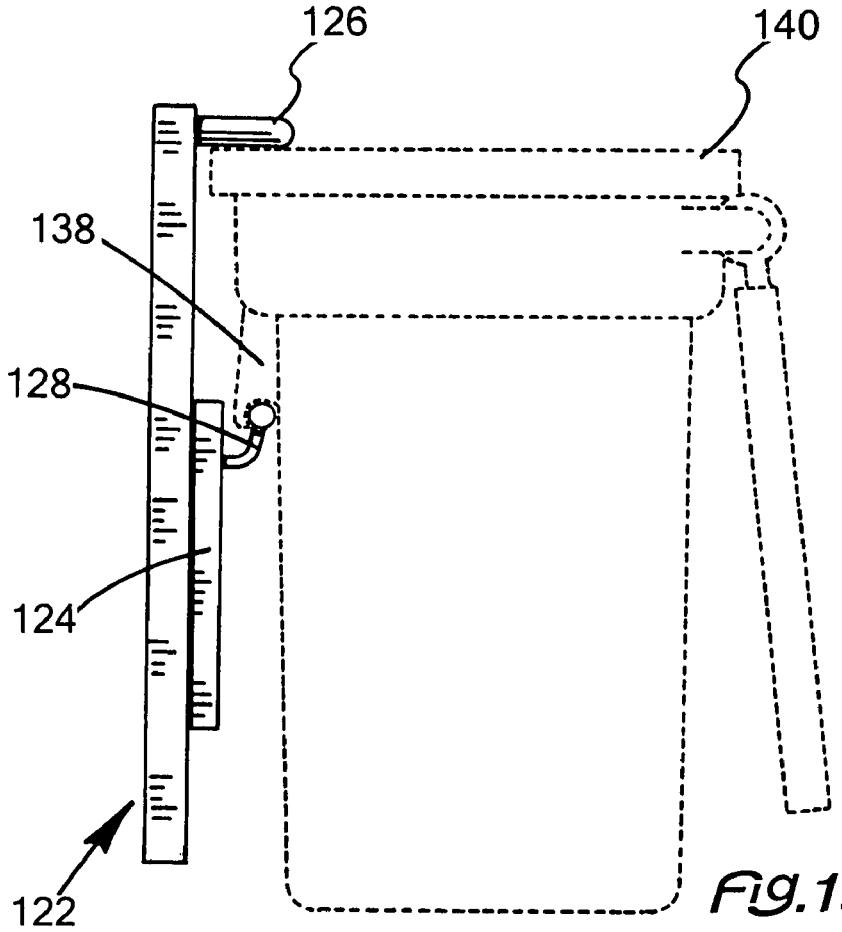
FIG. 19 depicts a side view of the lift and tilt assembly 122 with stop bar 126 attaching to trash container 140 shown in phantom.

Adding FIG. 2 and FIG. 19 to the consideration, the structure in relationship of wash bay 120 to lift and tilt assembly 122 becomes more clear. A tilt cylinder 190 is mounted on either side of wash bay 120 to cooperate with lift and tilt assembly 122. Lift and tilt assembly 122 has a pair of stop bars 126 thereon which cooperate with a lock frame 124. Lock frame 124 has a pair of container locks 128 thereon, with lock cylinder 130 adapted to move each container lock 128 adjacent to or away from stop bar 126. Container lock 128 engages grip boss 138, which is found on trash container 140.

The interaction between lock frame 124 and trash container 140 can be seen. Trash container 140 is placed adjacent to lock frame 124. Lock cylinder 130 moves lock frame 124 so that container lock 128 is able to engage grip boss 138. Lock frame 124 is connected to lift and tilt assembly 122 which has stop bar 126 to further secure trash container 140. Lift and tilt assembly 122 rotates the lock frame and trash container 140 into wash bay 120.

Figure 3:
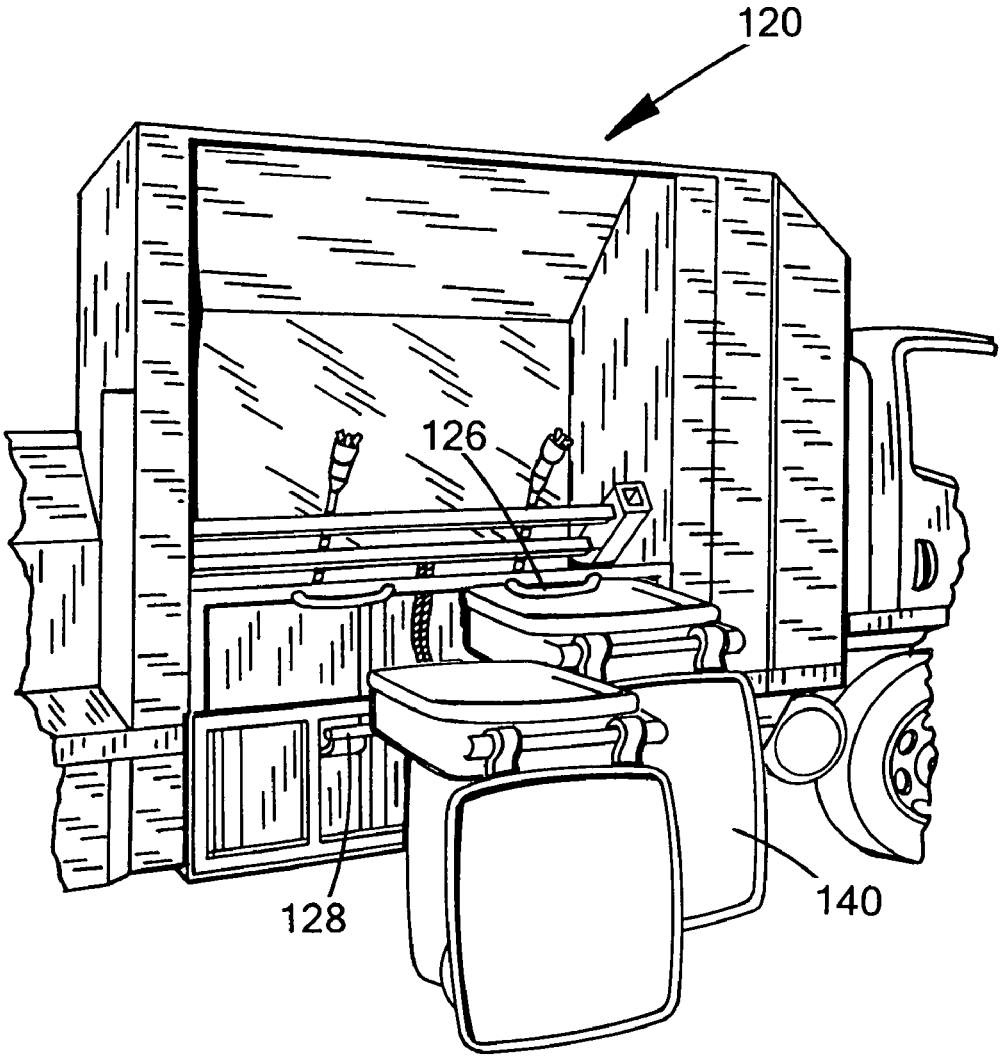
FIG. 3 depicts a perspective view of the vehicle mounted cleaning device 100 of this invention with trash container 140 thereon.

Now adding FIG. 3 to the consideration, the relationship between trash container 140 and lock frame 124 can be seen. The trash containers 140 (FIG. 19) are positioned adjacent to lock frame 124. As lock cylinder 130 lifts lock frame 124, each container lock 128 catches grip boss 138. Thus, trash container 140 is lifted to stop bar 126, where container lock 128 and stop bar 126 combine to support trash container 140. Then, the washing procedure for trash container 140 can proceed as vehicle mounted cleaning device 100 operates.

Figure 4:
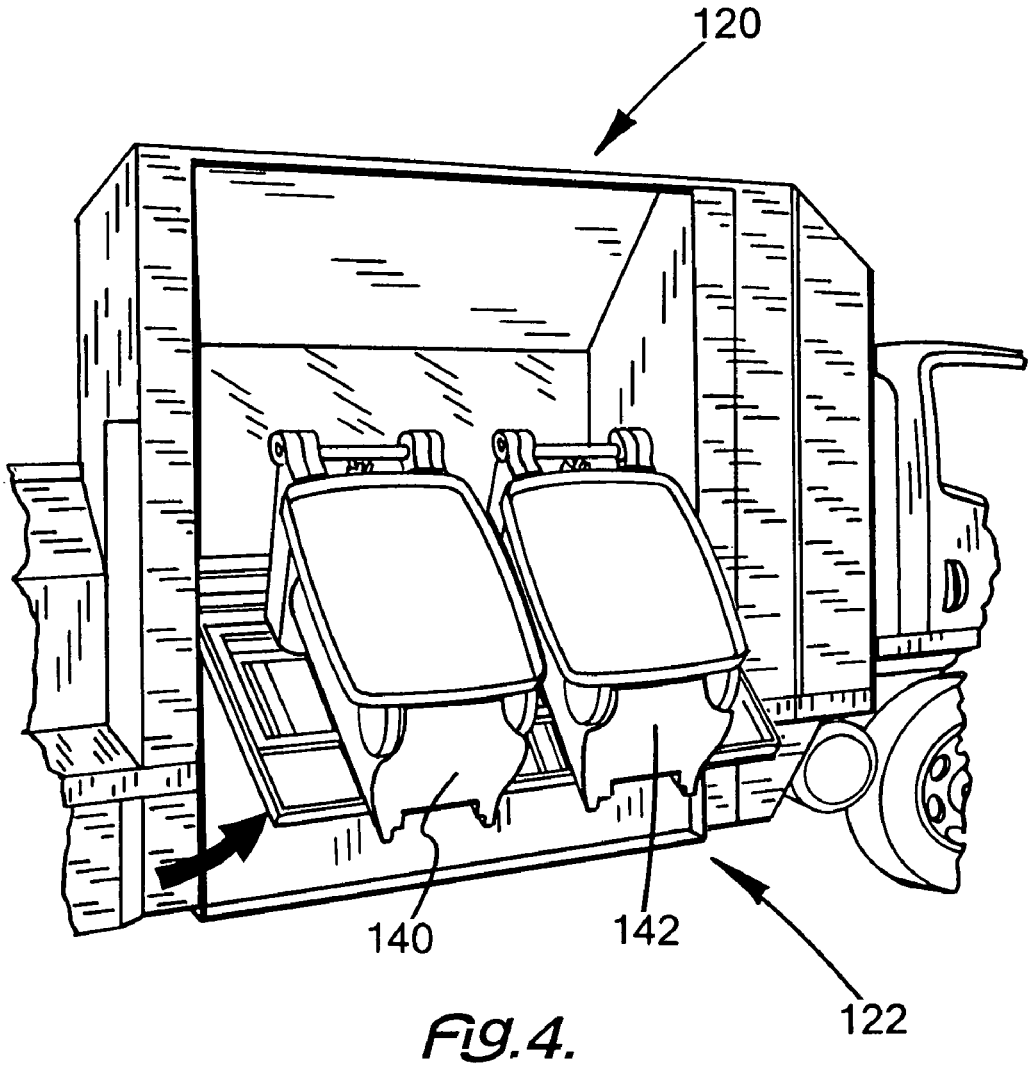
FIG. 4 depicts a perspective view of the lift and tilt assembly 122 with trash container 140 in a first position 142 toward the nozzle set 160 for an interior wash.
Figure 5:
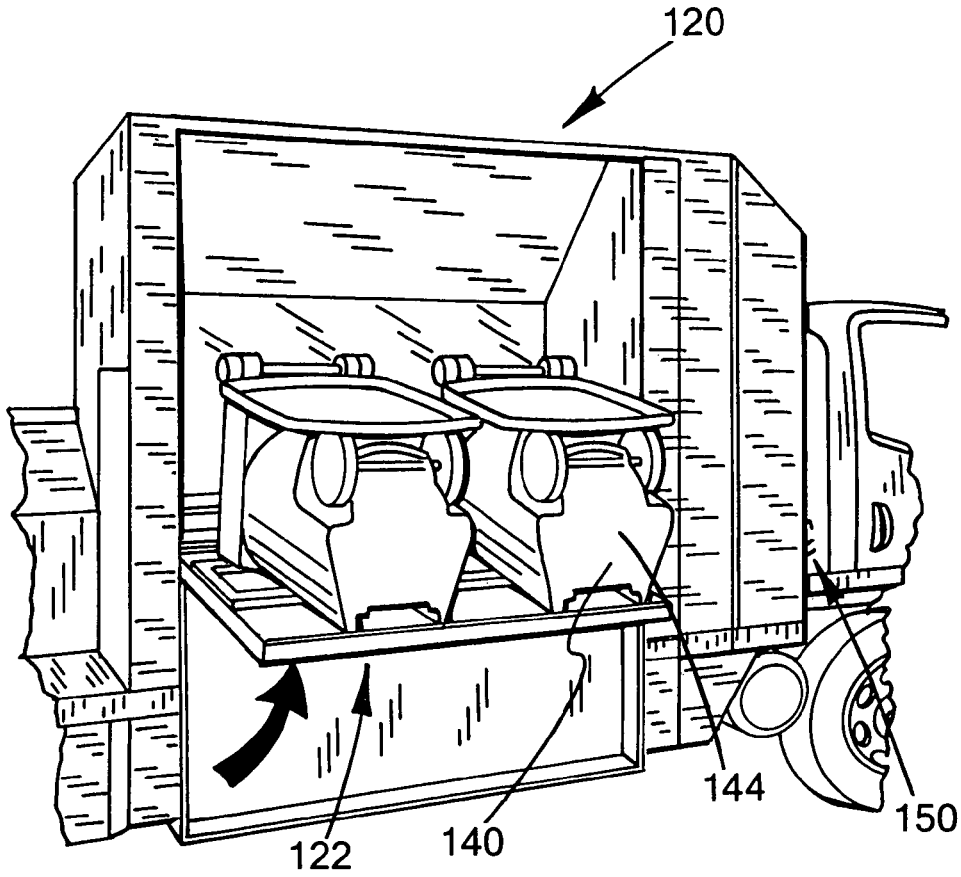
FIG. 5 depicts a perspective view of the lift and tilt assembly 122 with trash container 140 in a second position 144 toward the nozzle set 160.
Figure 6:
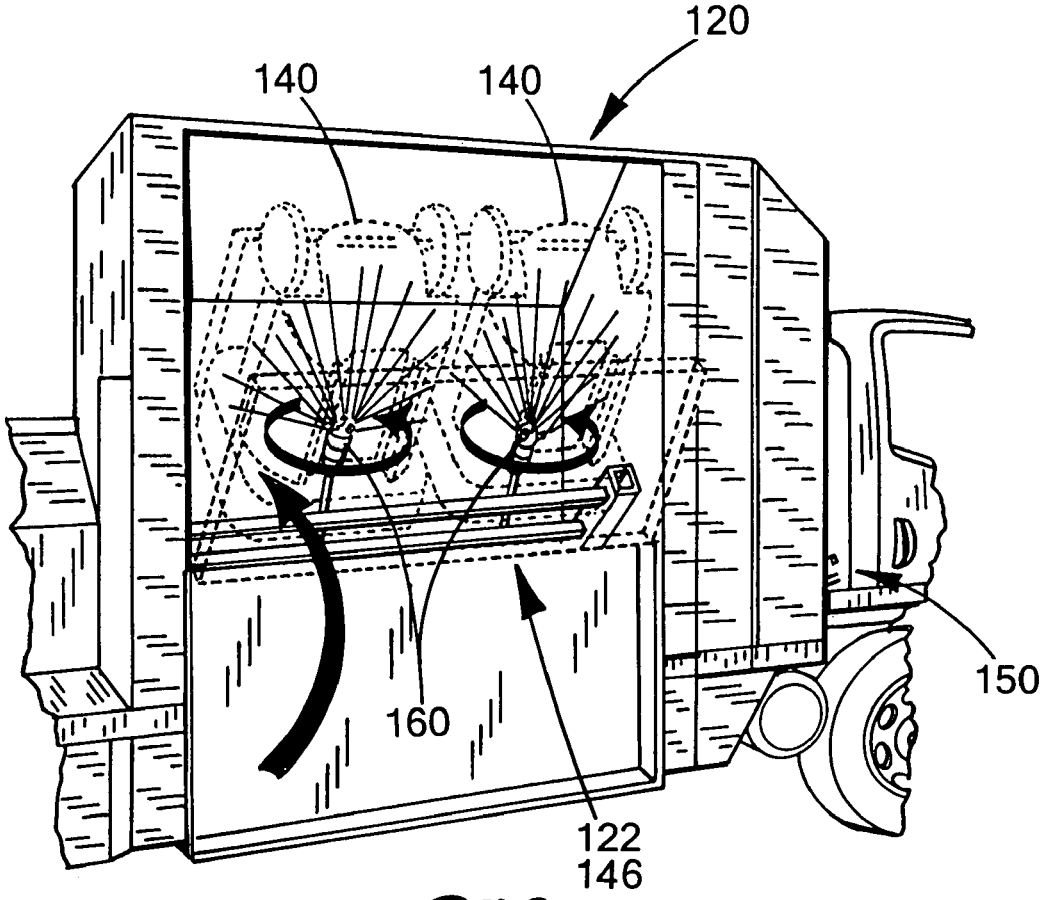
FIG. 6 depicts a perspective view of the lift and tilt assembly 122 with trash container 140 in a wash position 146 toward the nozzle set 160.

Now moving onto FIG. 4, FIG. 5 and FIG. 6, lifting of trash container 140, with the preferred lifting device, for washing is shown. In use, the lifting is a continuous process. However, the continuous motion is shown in positions for clarity of explanation. First position 142, as shown in FIG. 4, has the lifting of trash container 140 moving to and through first position 142 continuously due to the cooperation of container lock 128, grip boss, and stop bar 126 with the tilt cylinders 190. In FIG. 5, as trash container 140 is lifted further with the trash container 140 moving to and through second position 144, and tilted into the wash bay 120. Then in FIG. 6, as trash container stops at wash position 146, the interior of each trash container 140 is sprayed with a rotating nozzle set 160 by using control assembly 150.

Figure 7:
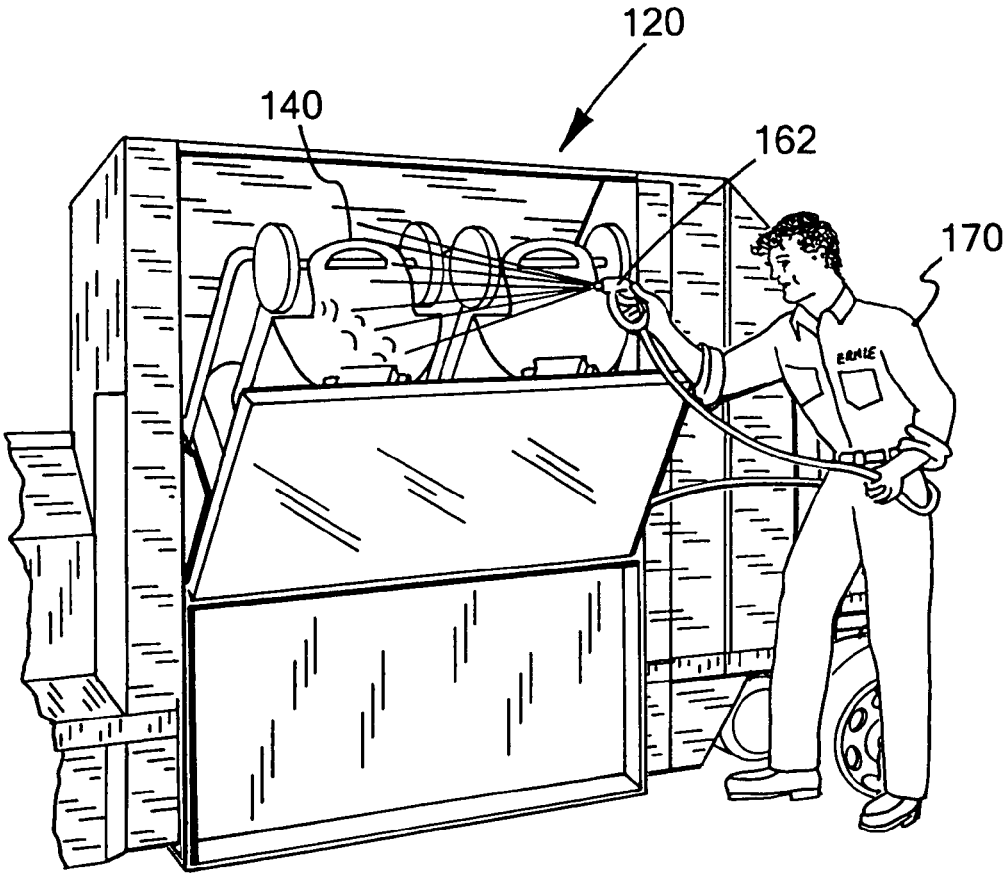
FIG. 7 depicts a perspective view of a person 170 washing the outside of the trash container 140, while the nozzle set 160 clean the inside of trash container 140.

In FIG. 7, one manner of completing the washing of trash container 140 has manual pressure washer 162 operated by a person 170 cleaning the outside of trash container 140 while nozzles 160 clean the inside (FIG. 6). So cleaning may be completed by the combination of manual pressure washer 162 with rotating nozzle set 160.

Figure 8:
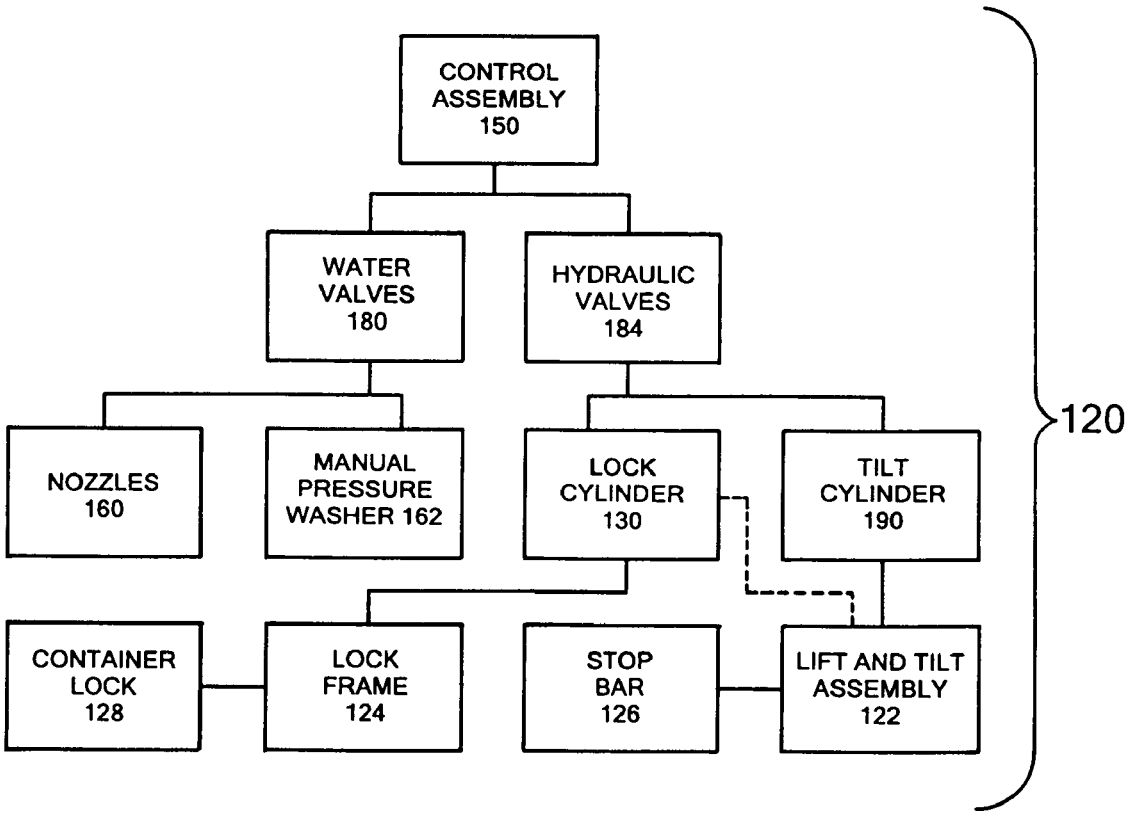
FIG. 8 depicts a block diagram of the wash bay 120 for the vehicle mounted cleaning device 100 of this invention.

These actions are summarized and expanded in FIG. 8. The control assembly 150 operates the water valves 180 and the hydraulic valves 184. As control assembly 150 operates water valves 180, nozzle set 160 and manual pressure washer 162 cooperate to clean the trash container 140.

Figure 9:
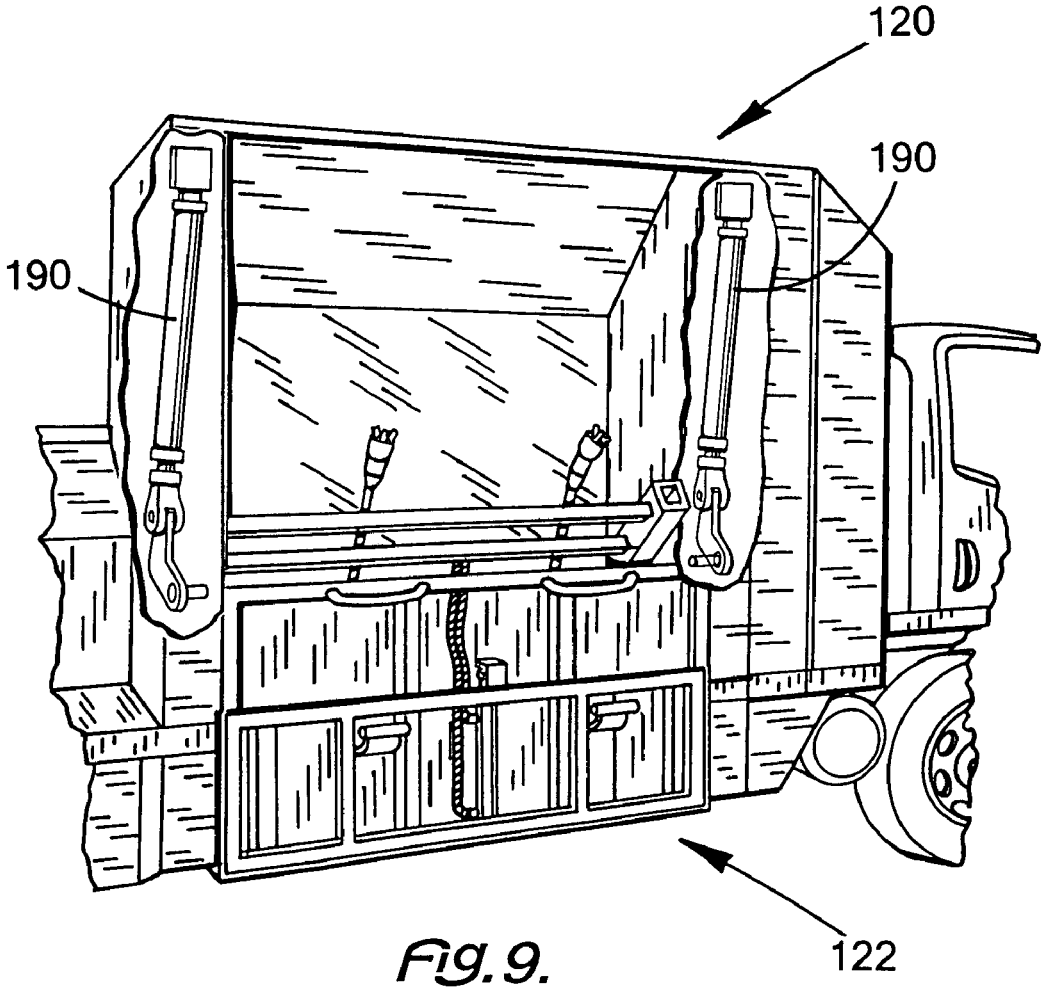
FIG. 9 depicts the tilt cylinder 190 for the lift and tilt assembly 122 and its location inside and at both sides of the wash bay 120.
Figure 10:
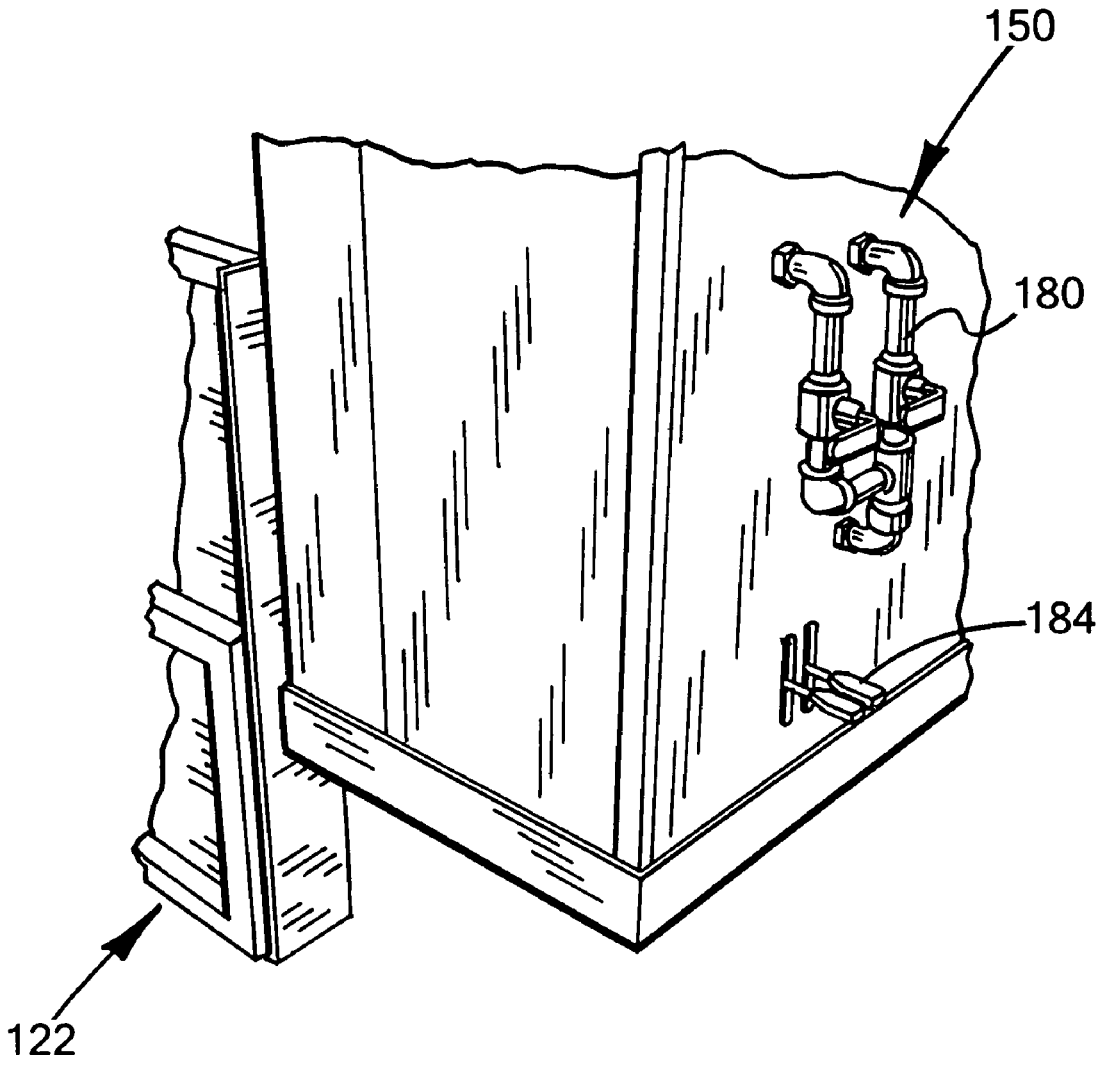
FIG. 10 depicts a perspective view of the control assembly 150 for the vehicle mounted cleaning device 100 of this invention.

With the addition of FIG. 9 and FIG. 10, valves may be discussed. The hydraulic valves 184 feed both the lock cylinder 130 and the tilt cylinder 190. The lock frame 124 uses an activated lock cylinder 130 to move the container lock 128 to the grip boss 138 and stop bar 126 and secure the trash container 140 to the lift and tilt assembly 122. Tilt cylinder 190 then moves the trash container 140 into the wash bay 120 (FIG. 1) for cleaning thereof by using water valves 180 from control assembly 150. Water valves 180 feed the nozzle set 160 and manual pressure washer 162.

Figure 11:
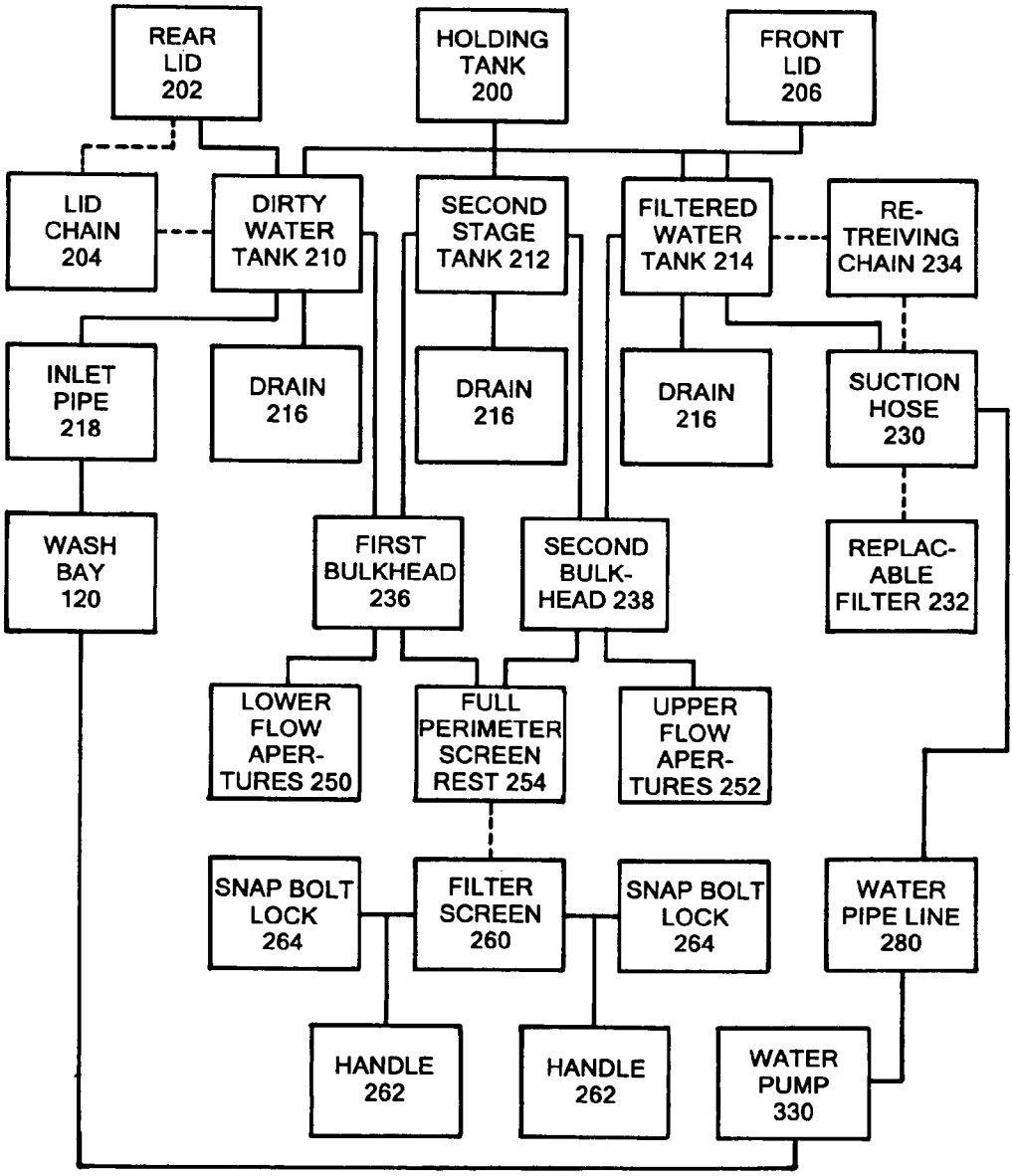
FIG. 11 depicts a block diagram of holding tank 200 and its system for the vehicle mounted cleaning device 100 of this invention.
Figure 12:
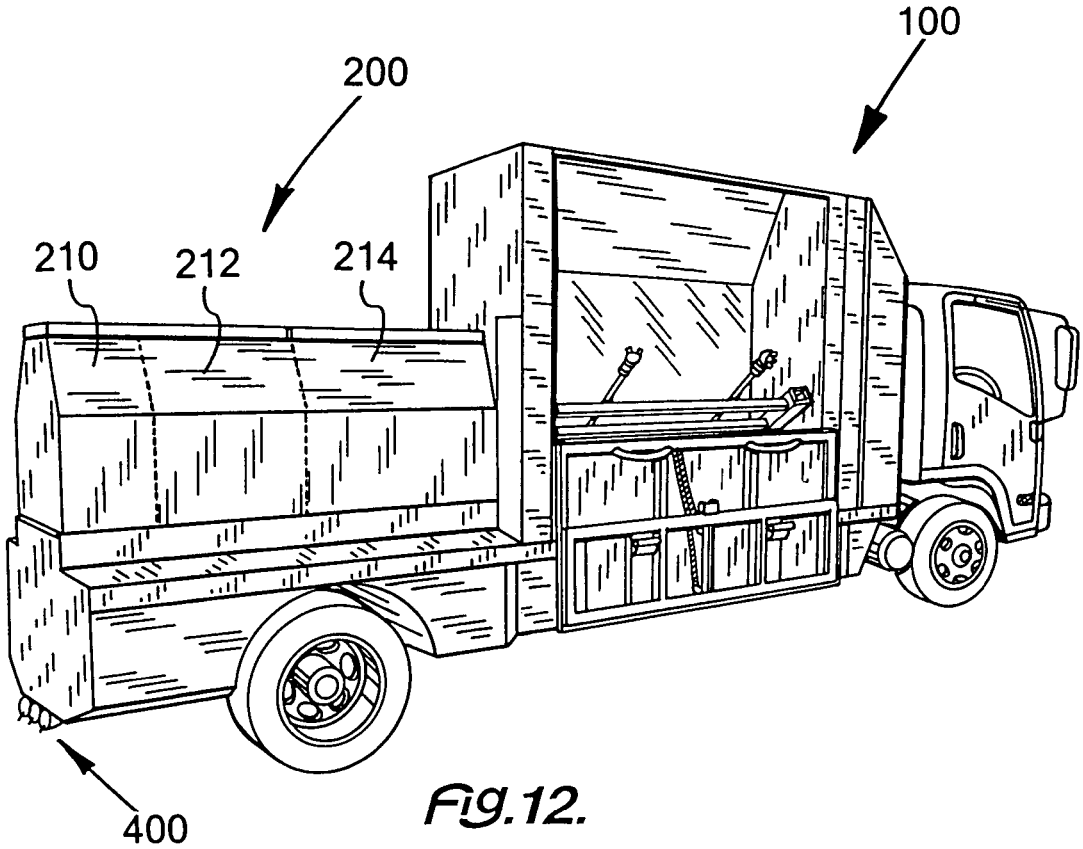
FIG. 12 depicts a perspective view of the vehicle mounted cleaning device 100 of this invention in general, and the holding tank 200 and its system in particular.

In FIG. 11 and FIG. 12, the water or cleaning fluid supply for vehicle mounted cleaning device 100 (FIG. 1) comes from holding tank 200. Holding tank 200 is divided into a dirty water tank 210, a second stage tank 212 and a filtered water tank 214. Because the dirty water tank 210 communicates with the second stage tank 212, which in turn communicates with the filtered water tank 214, only the filtered water tank 214 needs a drain 216. Preferably, all tanks have a drain 216. Filtered water tank 214 communicates with wash bay 120.

Dirty water tank 210 is closed by rear lid 202. If desired, rear lid 202 may be supported in an open position by a lid chain 204. An inlet pipe 218 feeds into dirty water tank 210. First bulkhead 236 divides holding tank 200 into dirty water tank 210 and second stage tank 212. First bulkhead 236 includes lower flow apertures 250, which permit fluid transport between dirty water tank 210 and second stage tank 212.

Mounted on the first bulkhead 236 and second bulkhead 238 is full perimeter screen rest 254. Filter screen 260 rests on full perimeter screen rest 254, and may be removed therefrom using one more of handles 262. Filter screen 260 may be additionally supported by one or more of snap bolt locks 264.

Second bulkhead 238 divides second stage tank 212 and filtered water tank 214. Second bulkhead 238 has upper flow apertures 252, which are higher in holding tank 200 than lower flow apertures 250. When water in second stage tank 212 is high enough to reach upper flow apertures 252. Then filtered water flows into filtered water tank 214 for use in cleaning. Thus, water is recycled. Filtered water tank 214 feeds water pump 330. From water pump 330, water is used and reused in wash bay 120 to complete the water recycling.

Filtered water tank 214 includes suction hose 230, which feeds water pump line 280 and then water pump 330. Suction hose 230 has a replaceable filter 232 at one end thereof to further filter the filtered water and assist in keeping the water clean or recyclable.

Figure 13:
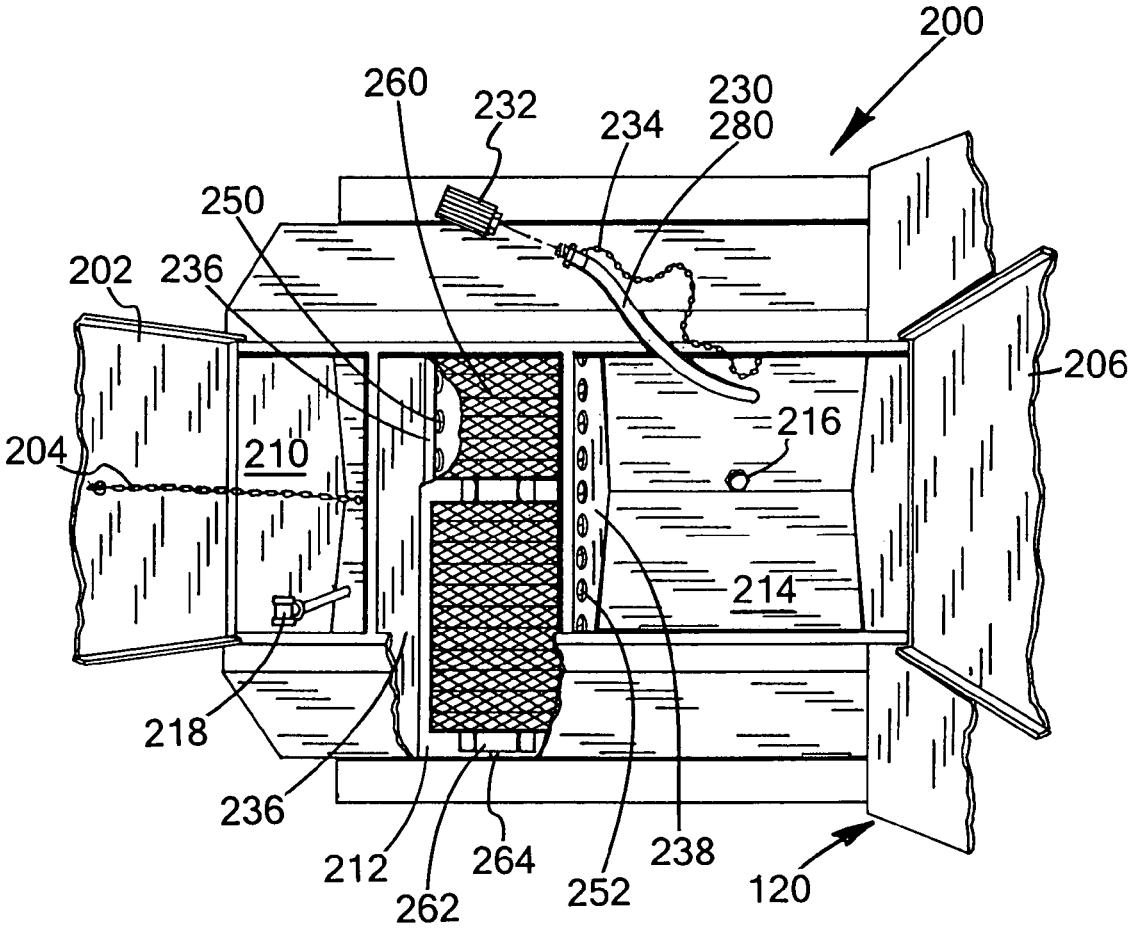
FIG. 13 depicts a top perspective view of the holding tank 200 with a partial section to show the lower flow apertures 250.

FIG. 12 combines with FIG. 13 to show a specific embodiment for FIG. 11. Vehicle 110 and cab 112 show wash bay 120 and holding tank 200, thereon. Below dirty water tank 210 of holding tank 200 is mounted the sludge exhaust hose 400. Sludge exhaust hose 400 communicates with the dirty water tank 210 and permits evacuation or draining thereof, when it is desired to add new cleaning fluid to the holding tank 200. Sludge exhaust hose also communicates with one or more drains 216 to remove the sludge that is removed from the used water.

Holding tank 200 is beveled and guides water and sludge downward toward drain 216. This acts as a filter for removing debris from the recycled water.

FIG. 13 further clarifies this structure. Holding tank 200 has rear lid 202 hinged to and covering dirty water tank 210. A lid chain 204 permits rear lid 202 to open and be supported without falling. When front lid 206 opens it rests against the wash bay 120, and does not require lid chain 204.

Especially considering FIG. 13, filtered water tank 214 has a drain 216, to permit emptying thereof when desired. Inlet pipe 218 receives dirty water from wash bay 120 and communicates with dirty water tank 210. Thus, control assembly 150 can be used to suck water through replaceable filter 232 into dirty water tank 210 after trash container 140 is washed. Such water is then processed for reuse.

First bulkhead 236 separates dirty water tank 210 from second stage tank 212. Lower flow apertures 250 appear in the bottom of first bulkhead 236. Lower flow apertures 250 permit water to flow from dirty water tank 210 into second stage tank 212 as water levels rise high enough to reach apertures 250. Second bulkhead 238 divides second stage tank 212 and filtered water tank 214. Within second stage tank 212 is a full perimeter screen rest 254. Full perimeter screen rest 254 supports a filter screen 260. Filter screen 260 is positioned above lower apertures 250 but below upper flow apertures 252. As water levels rise, pressure forces the water to rise in second stage tank 212 and pass through filter screen 260. Filter screen 260 assists in removing debris and impurities from the dirty water. Handle 262 on the top of filter screen 260 provides for removal, cleaning and reinsertion of the filter screen 260.

After passing through filter screen 260, water rises in second stage tank 212 to reach upper flow apertures 252 in second bulkhead 238. Filtered water can then flow into filtered water tank 214. As the water reaches upper flow apertures 252, it is filtered and becomes ready for use in filtered water tank 214. Suction hose 230 lies in the bottom of filtered water tank 214 with a replaceable filter 232 on the submerged end thereof. Retrieving chain 234 connects suction hose 230 and thereby replaceable filter 232 to the top of filtered water tank 214, thereby granting access to replaceable filter 232 for replacement, maintenance, or otherwise desired.

Suction hose 230 receives filtered water from filtered water tank 214 and further filters it with replaceable filter 232. Then, suction hose communicates with water pipeline 280 to feed water pump 330. Water pump 330 ultimately feeds nozzles 160 in wash bay 120.

Figure 14:
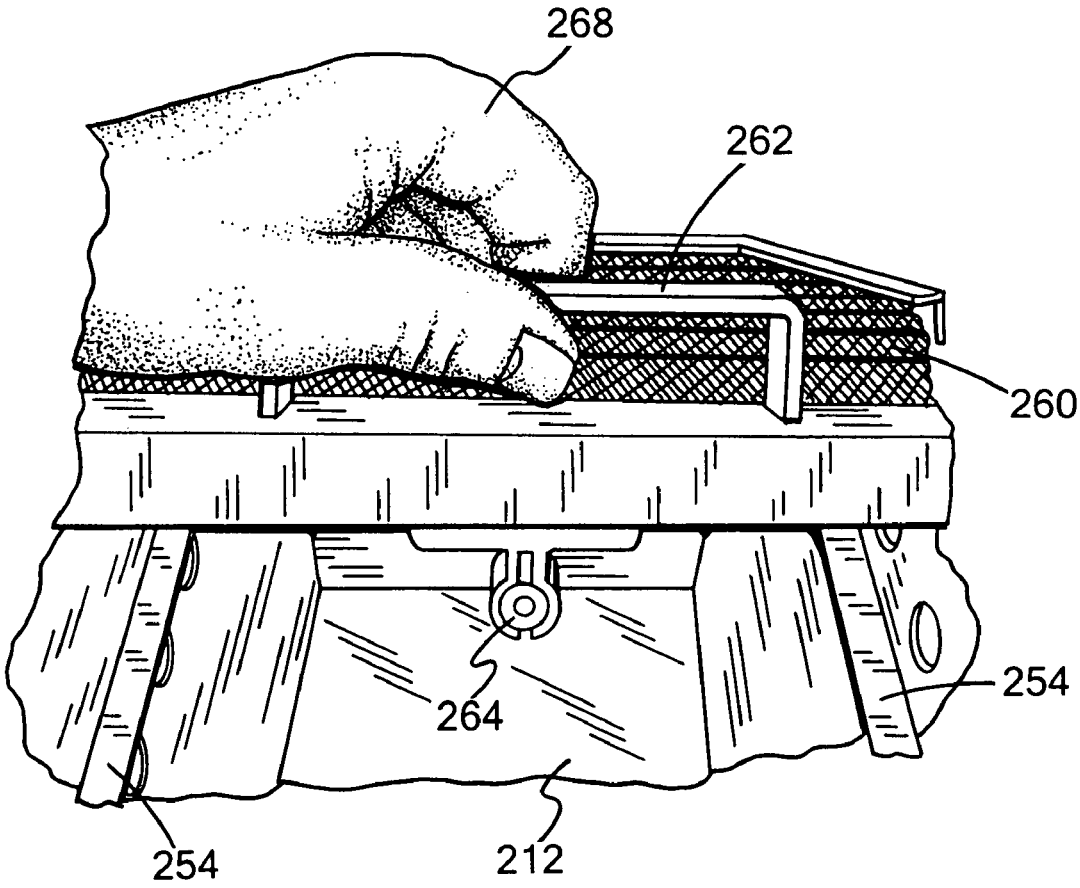
FIG. 14 depicts a perspective view of the snap bolt lock 264 of vehicle mounted cleaning device 100 of this invention.

Cleaning of the filter screen 260 becomes even more clear when considering FIG. 14. Full perimeter screen rest 254 supports filter screen 260. Snap bolt lock 264 is at the base of second stage tank 212, and cooperates with the full perimeter screen rest 254 to support the filter screen 260, until it is applied or removed for cleaning by hand 268. Snap bolt lock 264 is released. Then, handle 262 facilitates releasing of the filter screen 260 from the full perimeter screen rest 254. This easy access and removal allows for replacement or cleaning.

Figure 15:
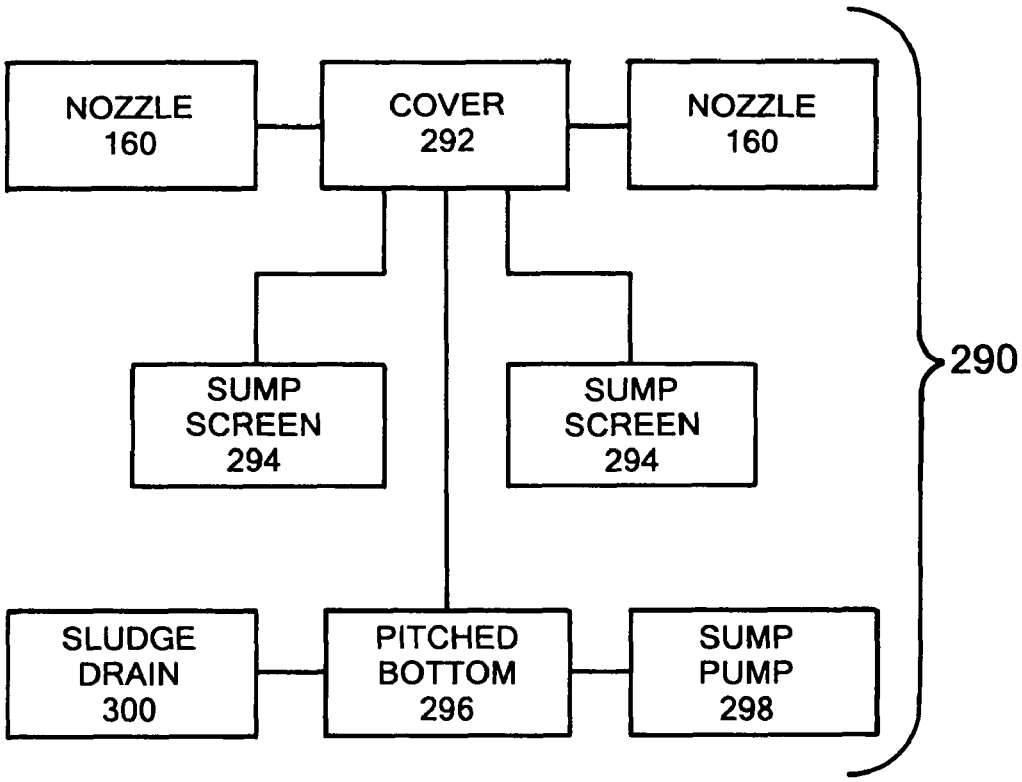
FIG. 15 depicts a block diagram of the sump 290 for the vehicle mounted cleaning device 100 of this invention.
Figure 16:
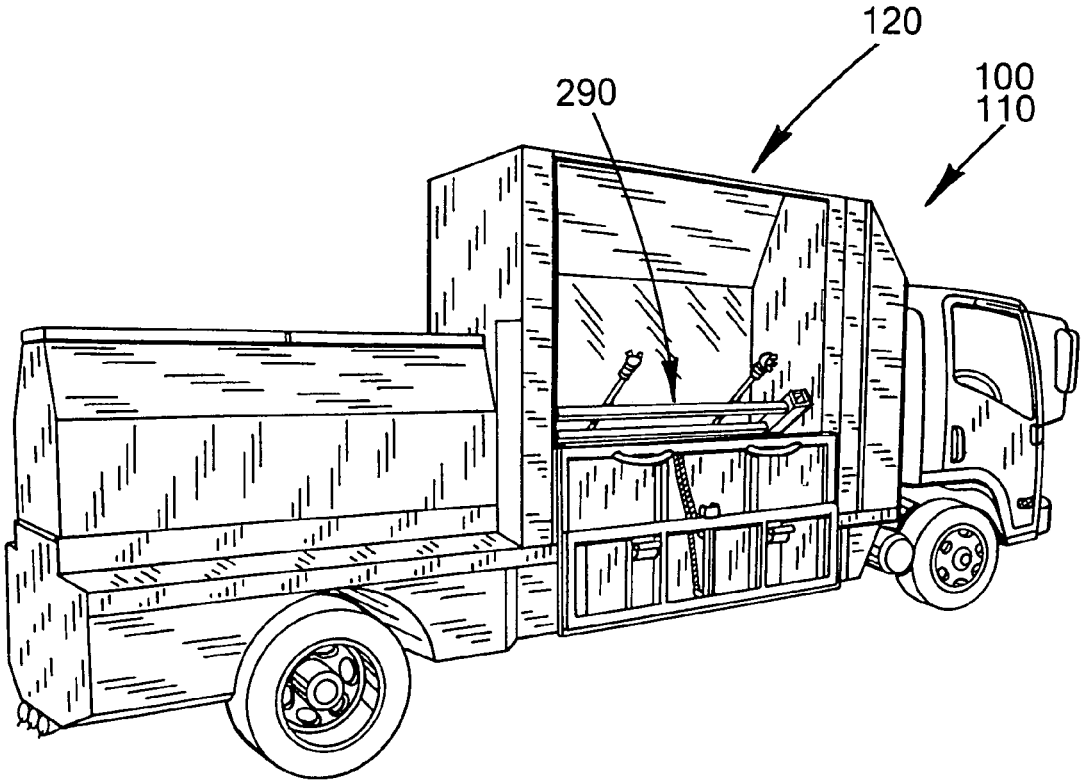
FIG. 16 depicts a perspective view of the sump 290 for the vehicle mounted cleaning device 100 of this, invention.
Figure 17:
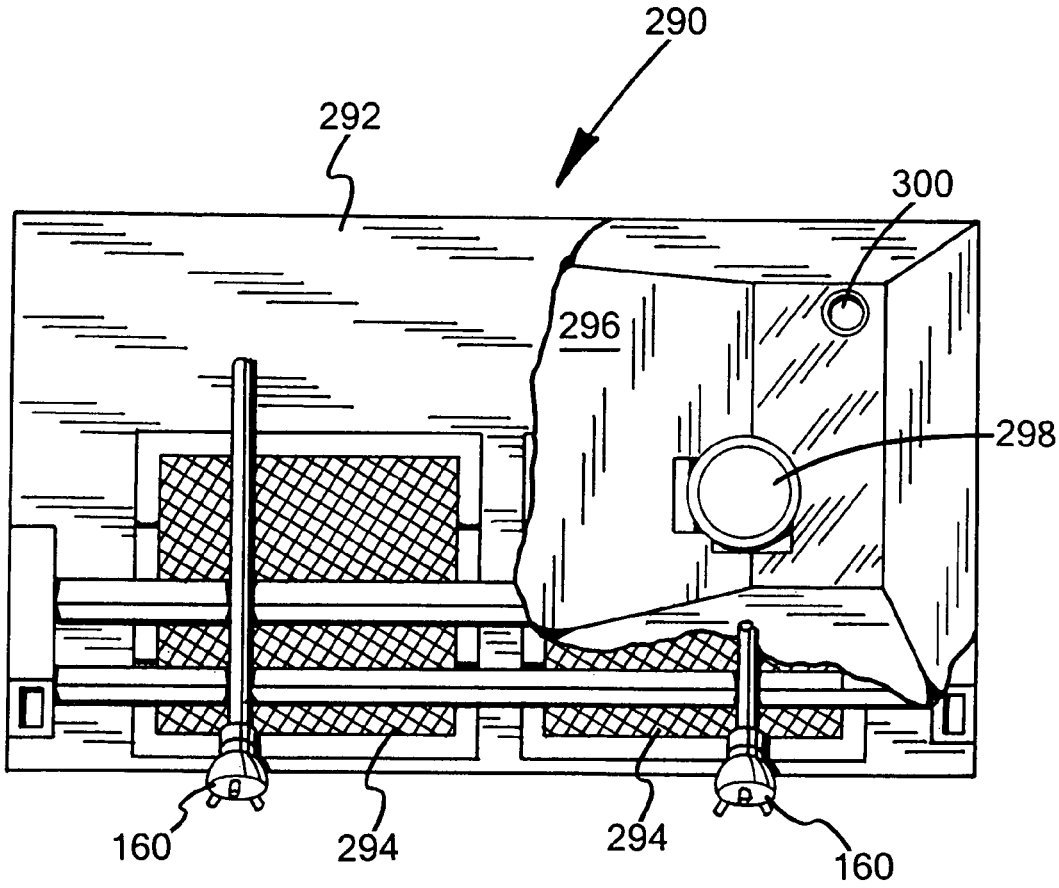
FIG. 17 depicts a top plan view of the sump 290 for the vehicle mounted cleaning device 100 of this invention with a partial section to show its components.

With FIG. 15, FIG. 16 and FIG. 17, the arrangement of sump 290 becomes more clear. Contained in wash bay 120 is sump 290. The cover 292 serves as the floor of the wash bay 120 and the cover of the sump 290. Nozzle sets 160 are paired, with each being able to clean one trash container 140 separately or at the same time. Sump screens 294 in the bottom of wash bay 120 filter trash and debris that is removed from trash containers 140. The pitched bottom 296 of wash bay 120 directs wash water to sump pump 298 and sludge drain 300. Such action permits sump pump 298 to direct water back to dirty water tank 210 through inlet pipe 218, for recycling, cleaning and reuse. Sludge drain 300 rests on a flat portion of pitched bottom 296. Sludge drain 300 has a shut off valve which can open or dose sludge drain 300 as desired. Sludge drain 300 permits removal of the dirty cleaning fluid as desired, or when such may be accomplished in an ecologically or sanitarily appropriate manner.

Figure 18:
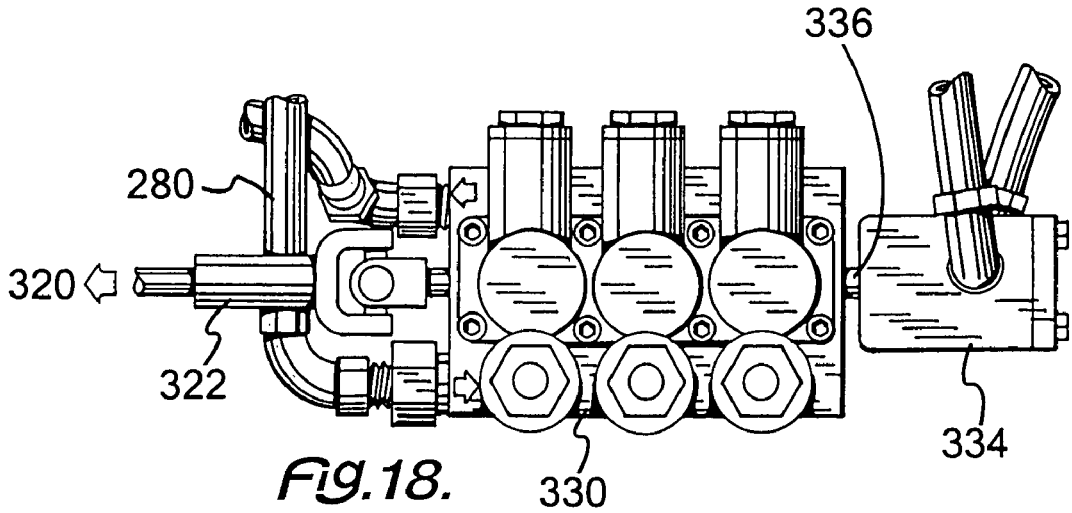
FIG. 18 depicts a perspective view of the water pump 330 and hydraulic pump 334 and their connection by a common shaft 336 for the vehicle mounted cleaning device 100 of this invention.

Now, considering FIG. 18, the transmission 320 of vehicle 110 (FIG. 1) is used to power the wash bay 120. A power take off shaft 322 is connected to the transmission 320. Power take off shaft 322 runs the water pump 330. Water pump 330 receives filtered water from suction hose 230 which feeds water pipeline 280. The hydraulic pump 334 is operated by the common shaft 336, which is powered with the power take off shaft.

In this manner, trash containers 140 may be cleaned on site at the home of a person. Water and other cleaning are used, reused and stored. Then the cleaning solution will find a proper disposal area.

This application taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A vehicle mounted cleaning device for a garbage or trash container comprising:

the vehicle mounted cleaning device having a wash bay to receive the garbage or trash container from a side of a vehicle;

the vehicle supporting the vehicle mounted cleaning device;

a holding tank being adjacent to the wash bay;

the wash bay having at least one cleaning nozzle therein;

the holding tank having at least one hose therein;

the at least one hose communicating with the at least one cleaning nozzle in order to provide fluid for cleaning the garbage or trash container;

a lifting device being mounted adjacent to the wash bay;

the lifting device being adapted to lift the garbage or trash container from a position into the wash bay for a washing step of the garbage or trash container;

the garbage or trash container being returnable to the position after the washing step;

the lifting device including a lift and tilt assembly for releasably securing the garbage or trash container;

the lift and tilt assembly including a lock frame;

the lift and tilt assembly having at least one stop bar;

the lock frame having at least one container lock;

the container lock being adapted to contact the garbage or trash container and cooperate with the stop bar to secure the garbage or trash container for a tilting maneuver;

at least one tilt cylinder being mounted adjacent to the wash bay;

the at least one tilt cylinder cooperating with the lift and tilt assembly in order to raise and lower the trash or garbage container;

the trash or garbage container being tilted into the wash bay;

the at least one stop bar being a first stop bar and a second stop bar;

the at least one container lock being a first container lock and a second container lock;

the first stop bar cooperating with the first container lock;

the second stop bar cooperating with the second container lock;

a lock cylinder cooperating with the lock frame to lift the trash or garbage container to the stop bar;

a control assembly operating a water valve system and a hydraulic system;

the water valve system feeding water to the nozzle system and a manual pressure washer in order to cooperate and clean the trash container;

the hydraulic system including at least one hydraulic valve to operate the lock cylinder and the tilt cylinder;

a holding tank providing a water supply for the wash bay;

the holding tank having the recycling tank, a second stage tank and the cleaning fluid tank;

the recycling tank and the wash bay being on opposing sides of the cleaning fluid tank;

the recycling tank communicating with the second stage tank;

the second stage tank communicating with the cleaning fluid tank;

the recycling tank receiving water from the wash bay after the water is used to wash the trash or garbage container;

a rear lid releasably closing the recycling tank;

an inlet pipe feeding into the recycling tank;

a first bulkhead dividing the holding tank into the recycling tank and the second stage tank;

the first bulkhead including lower flow apertures in order to permit fluid transport between the recycling tank and the second stage tank;

a second bulkhead dividing the holding tank into the cleaning fluid tank and the second stage tank;

a rear full perimeter screen rest being mounted on the first bulkhead and the second bulkhead;

a removable filter screen resting on full perimeter screen rest;

the second bulkhead having upper flow apertures positioned higher in the holding tank than the lower flow apertures;

the filter screen having at least one handle to facilitate removal or insertion thereof; and the filter screen being supported by at least one snap bolt lock.

* * * * *